US008069577B1

(12) United States Patent
Willman et al.

(10) Patent No.: US 8,069,577 B1
(45) **Date of Patent: *Dec. 6, 2011**

(54) OPTICAL SIGHT DEVICE

(76) Inventors: James A. Willman, Suffolk, VA (US); George W. Willman, Suffolk, VA (US)

( * ) Notice: Subject to any disclaimer, the term of this patent is extended or adjusted under 35 U.S.C. 154(b) by 59 days.

This patent is subject to a terminal disclaimer.

(21) Appl. No.: 12/459,651

(22) Filed: Jul. 6, 2009

(51) Int. Cl.
*F41G 1/467* (2006.01)

(52) U.S. Cl. ..... 33/265; 33/297; 124/87; 42/122

(58) Field of Classification Search ..... 33/265, 33/297, 298, 333, 334, 347, 365, 391, 398; 124/87; 42/97, 122, 130, 135–138
See application file for complete search history.

(56) References Cited

U.S. PATENT DOCUMENTS

| | | | | |
|---|---|---|---|---|
| 3,554,619 | A * | 1/1971 | Irwin | 384/536 |
| 3,997,974 | A * | 12/1976 | Larson | 33/265 |
| 4,090,305 | A * | 5/1978 | Cassidy | 42/121 |
| 5,223,650 | A * | 6/1993 | Finn | 42/122 |
| 6,311,405 | B1 * | 11/2001 | Slates | 33/265 |
| 6,321,479 | B1 * | 11/2001 | Sheehan | 42/111 |
| 6,453,898 | B1 * | 9/2002 | Altmann et al. | 124/87 |
| 7,100,292 | B2 * | 9/2006 | Afshari | 33/265 |
| 7,200,944 | B2 * | 4/2007 | Rager | 33/265 |
| 7,243,432 | B1 * | 7/2007 | Rager | 33/265 |
| 7,275,328 | B1 * | 10/2007 | Rager | 33/265 |
| 7,308,891 | B2 * | 12/2007 | Graf | 124/87 |
| 7,331,112 | B2 * | 2/2008 | Gibbs | 33/265 |
| 7,353,611 | B2 * | 4/2008 | Edwards et al. | 33/265 |
| 7,360,313 | B1 * | 4/2008 | Hamm et al. | 33/265 |
| 7,412,774 | B2 * | 8/2008 | Lu et al. | 33/290 |
| 7,461,460 | B2 * | 12/2008 | Priebe | 33/265 |
| 7,503,122 | B2 * | 3/2009 | Afshari | 33/265 |
| 7,581,325 | B1 * | 9/2009 | Willman et al. | 33/265 |

* cited by examiner

*Primary Examiner* — Amy Cohen Johnson
(74) *Attorney, Agent, or Firm* — Wooten & Shaddock, PLC

(57) ABSTRACT

An optical sight having a reference housing having a reference housing aperture formed therein; at least one reference point positioned within the reference housing aperture; an eclipsed ring having an eclipsed ring aperture formed therein; wherein the eclipsed ring includes a pivot aperture formed therein, wherein the eclipsed ring is pivotably coupled, via a pivot pin extending through the pivot aperture, to the reference housing such that the eclipsed ring may pivot relative to the reference housing and such that the eclipsed ring naturally pivots to a predetermined position, and wherein the eclipsed ring is pivotably coupled such that a first side surface of the eclipsed ring faces generally towards a second side surface of the reference housing; and at least one surface preparation on the first side surface of the eclipsed ring, wherein the surface preparation is visually distinguishable from a surface of the reference housing aperture.

19 Claims, 18 Drawing Sheets

OPTICAL SIGHT DEVICE

CROSS-REFERENCE TO RELATED APPLICATIONS

This nonprovisional patent application claims the benefit of U.S. patent application Ser. No. 12/154,362, filed May 22, 2008, which claims the benefit of U.S. Provisional Patent Application Ser. No. 60/931,265, filed May 22, 2007, the entire disclosures of which are incorporated herein by reference.

BACKGROUND OF THE INVENTION

1. Field of the Invention

This invention relates generally to optical sights. In particular, the present invention relates to an optical sight that may be used to determine whether a particular device or a component of a device is at a predetermined angle with respect to a given plane.

2. Description of Related Art

Archery is a test of the mind and the body where minute changes are greatly amplified by the distance, speed, and environment down range. The skilled archer must maintain proper mental composure, skill the body and square the frame in order to be successful. It is essential, therefore, an archer keep the bow both on target and on level to maximize accuracy and precision.

To assist the archer in aiming, a sight is frequently employed, often in conjunction with a traditional bubble level attachment. Used properly, the archer is able to physically aim and square the bow prior to release.

Similar targeting measures are taken in numerous ranged applications, such as sports.

SUMMARY OF THE INVENTION

However, known optical sights, and in particular, leveling devices, generally require the user to focus either on the sight (or leveling device) or the target. Unfortunately, it is common for a user to first focus on the sight (or leveling device) and any shift focus to the target. When focus is shifted to the target, it is quite easy for the user to shift off of level/plane without realizing it.

Thus, the present invention relates generally to an improved optical sight that is based on the principles of induced alignment, occlusive geometry, and human visual perception. The present invention exploits all for a significant product and process improvement upon existing sights. A working sample is described herein in the form of an archery sight, though the governing design and tenants are widely applicable to most targeting applications.

In various exemplary, nonlimiting embodiments, the optical sight of the present invention includes at least some of a reference housing, a reference point, and an eclipsed item.

Induced alignment. As described herein, when the eclipsed item is occluded, indicating proper alignment, an inherently obvious sight picture is presented to the user. Alignment is induced by a constant or quasi-constant force or phenomena (ae). In the sample, this force is gravity, but may be any capable force such as electromagnetic, phototropic, or the like.

Occlusive geometry. In various exemplary embodiments, the reference housing and the eclipsed object may be of arbitrary geometry, such that it is wholly or partially occluded from the user's view at an arbitrary length. In many instances, the reference housing and the eclipsed object may share identical geometry, but this need not be so given scaling, perception, materials, and design aesthetics to produce the desired effect of an inherently clear target picture when the sight is level and on target.

Human visual perception. The human eye is famously sensitive to motion under even poor lighting conditions. When used properly, the optical sight of the present invention provides an inherently clear target picture when the sight is level and on target, and provides an instantly accessible indication and comprehensible feedback for corrective action when desired conditions are not met. High-contrast, low light, illumination, and visual aids supplement any and all design aspects and parts.

Accordingly, this invention provides an optical sight of improved design.

This invention separately provides a sight, which is capable of having one or more reference point sights.

This invention separately provides an optical sight, which can be retrofitted to an existing device.

These and other features and advantages of this invention are described in or are apparent from the following detailed description of the exemplary, non-limiting embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
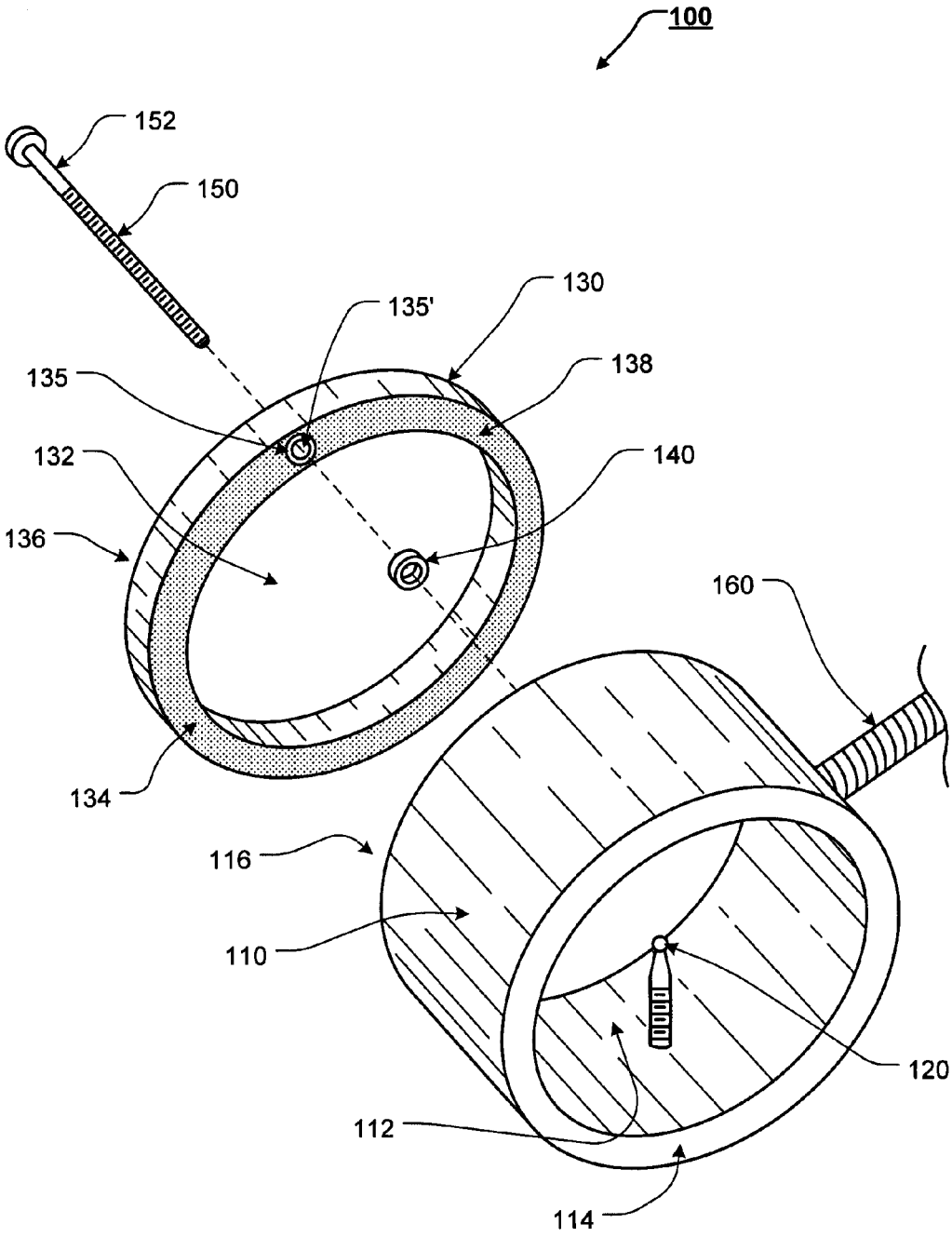
FIG. 1 shows an exploded perspective view of a first exemplary embodiment of an optical sight according to this invention.
Figure 2:
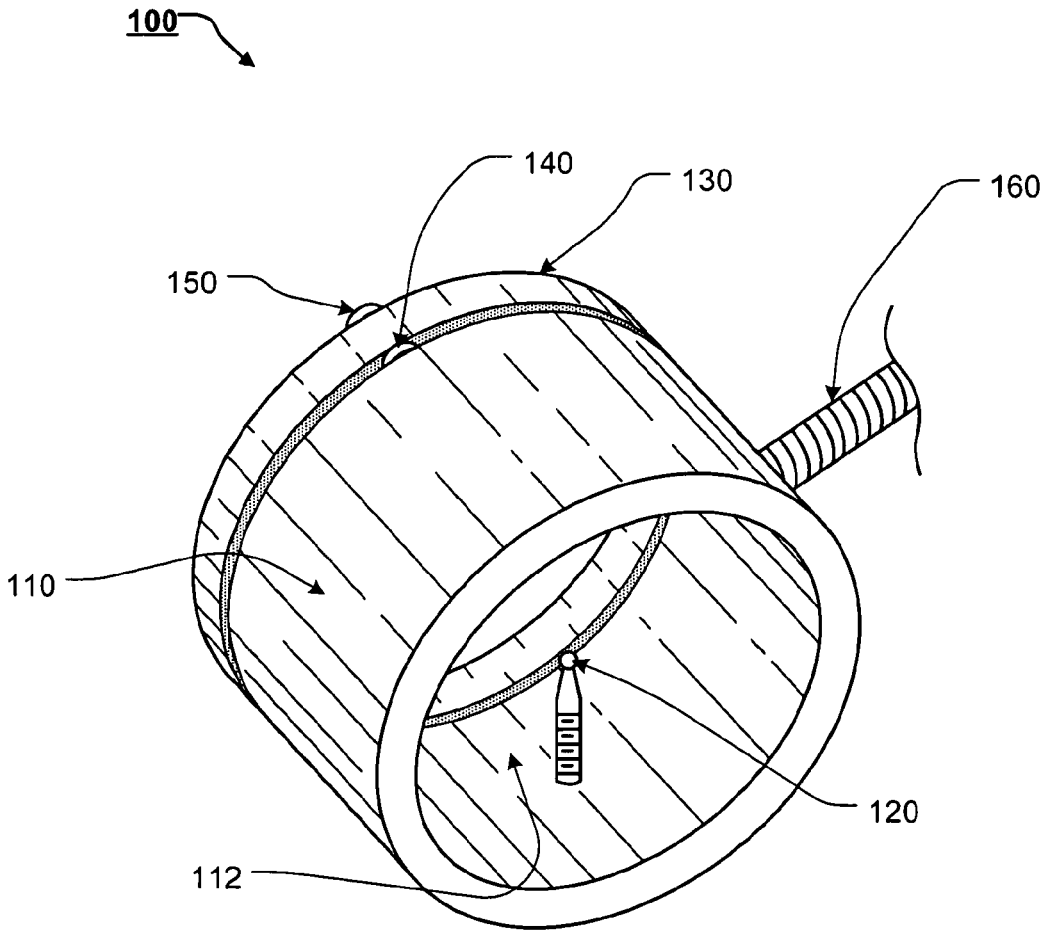
FIG. 2 shows a perspective view of a first exemplary embodiment of an optical sight according to this invention.

For simplicity and clarification, the design factors and operating principles of the optical sight according to this invention are explained with reference to various exemplary embodiments of an optical sight according to this invention. The basic explanation of the design factors and operating principles of the optical sight are applicable for the understanding, design, and operation of the optical sight of this invention.

It should also be appreciated that, as used herein, the terms "sight" and/or "archery sight" are used for basic explanation and understanding of the operation of the systems, methods, and apparatuses of this invention. Therefore, the terms "sight" and/or "archery sight" are not to be construed as limiting the systems, methods, and apparatuses of this invention. Thus, the terms "sight" and/or "archery sight" are to be understood to broadly include any instrument or device to aid in aligning a device with a target. For example, the terms "sight" and/or "archery sight" are to be understood to broadly include any strip, bead, crosshair, notch and post combination, and/or any other traditional or non-traditional instrument or device that is used to aid in aligning a device with a target, i.e., an electronic representation of such.

It should be appreciated that the optical sight, sight picture, sight presentation or occlusion ring can be adapted to many applications where the presence of a "level" or alignment to a particular angle is needed or desired. For example, the optical sight, sight picture, sight presentation or occlusion ring of the present invention can be used in conjunction with gun sights, gun scopes, bow sights, targeting sight representations and their analogies, compass roses, surveying equipment, image capture devices and adjuncts, and any other device used for determining direction or orientation, or where ready visual feedback of such may be of interest.

While various exemplary optical sights are described as being utilized in combination with an archer's bow, it should be appreciated that the optical sight of the present invention may be utilized in conjunction with any object, instrument, or device that must be aligned with a particular target. Thus, it should be understood that the specific application of the optical sight as illustrated herein is merely for exemplary purposes and the optical sight could be used with devices of other types.

Turning now to the drawing figures, FIGS. 1-6 show a first exemplary embodiment of an optical sight 100 according to this invention. As illustrated in FIGS. 1-6, the optical sight 100 comprises at least some of a reference housing 110 having a reference housing aperture 112 formed within the reference housing 110, a reference point 120, an eclipsed ring 130 having an eclipsed ring aperture 132 formed within the eclipsed ring 130, and a pivot pin 150.

In various exemplary embodiments, the reference housing 110 is an elongate, cylindrical container, of an arbitrary geometry. When viewed on end, the reference housing 110 allows visualization of the reference point 120 (i.e., the sight) and a target, through the reference housing aperture 112. In various exemplary embodiments, the reference housing 110 is a black ring or tunnel with reference point 120 mounted at its center.

The reference housing 110 extends from a first side surface 114 to a second side surface 116. The first side surface 114 faces a user looking through the reference aperture 112, while the second side surface 116 faces away from the user, toward a target.

In various exemplary embodiments, the reference point 120 is mounted or suspended at the center of the reference housing aperture 112 of the reference housing 110. In various exemplary embodiments, the reference point 120 comprises a sight, such as, for example, a pin sight. The pin sight is widely used in numerous fashions for targeting. In various exemplary embodiments, the reference point 120 comprises a fiber optic filament set atop a machined metal pin. In this manner, the reference point 120 remains at a fixed location within the reference aperture 112.

It should be appreciated that any known or later developed sight or targeting device may be used to provide the fixed sight or reference point 120.

The eclipsed ring 130 comprises an item having a similar geometry to the reference housing 110. However, it should be appreciated that the eclipsed ring 130 may comprise an arbitrary geometry that differs from the reference housing 110. The eclipsed ring 130 extends from a first side surface 134 to a second side surface 136. The first side surface 134 faces generally towards the reference housing and towards a user looking through the reference aperture 112, while the second side surface 136 faces away from the user, toward a target.

In various exemplary embodiments, the pivot point 150 is used to couple the eclipsed ring 130 to the reference housing 110. The pivot pin 150 may be positioned in an arbitrary position about the reference housing 110 and eclipsed ring 130. However, the pivot pin 150 allows for the semi or completely independent motion of the eclipsed ring 130 relative to the reference housing 110.

As illustrated in FIG. 1, the pivot point 150 may comprise, for example, a machine or other screw. In various exemplary embodiments, the pivot pin 150 includes a smooth portion 152, formed in a section of the pivot pin 150 that will come in contact with the pivot aperture 135' of the eclipsed ring 130. By including the optional smooth portion 152, the eclipsed ring 130 is able to pivot, more easily, around the pivot pin 150.

In certain exemplary embodiments, bearings 135 may be included within the pivot aperture 135'. Such bearings 135, if included, further aid in the free rotation of the eclipsed ring 130 about the pivot pin 150. Alternatively or additionally, bearings may be included within the reference housing 110 to further aid in the free rotation of the pivot pin 150 within the reference housing 110.

An optional spacer 140 is positioned around the pivot pin 150, between the reference housing 110 and the eclipsed ring 130. The optional spacer 140, if included, acts to separate the second side surface 116 of the reference housing 110 from the first side surface 134 of the eclipsed ring 130.

Figure 12A:
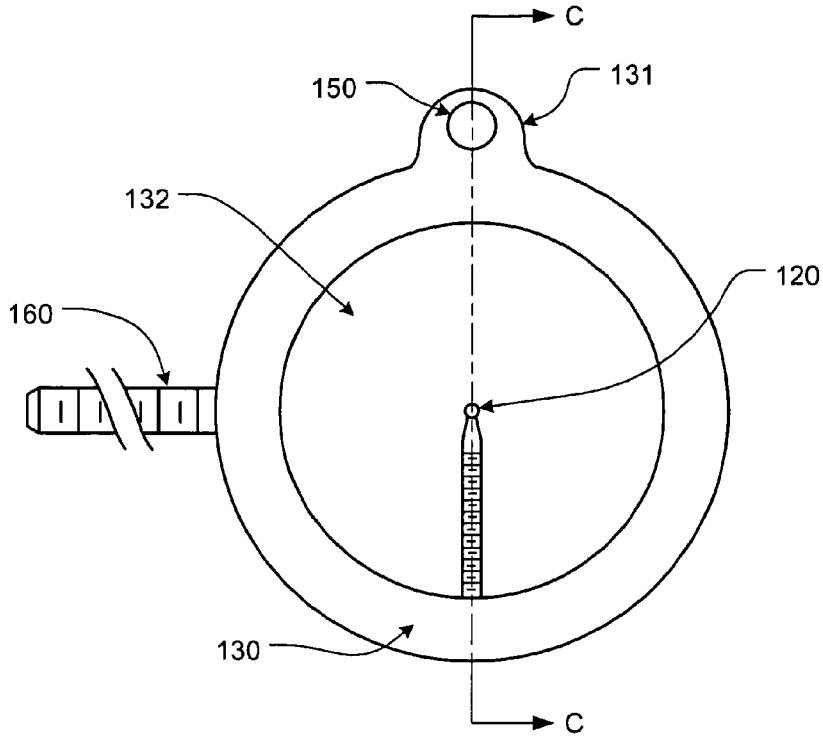
FIG. 12A shows a rear view of an exemplary embodiment of an optical sight according to this invention, wherein the pivot point is positioned within a pivot housing.
Figure 12B:
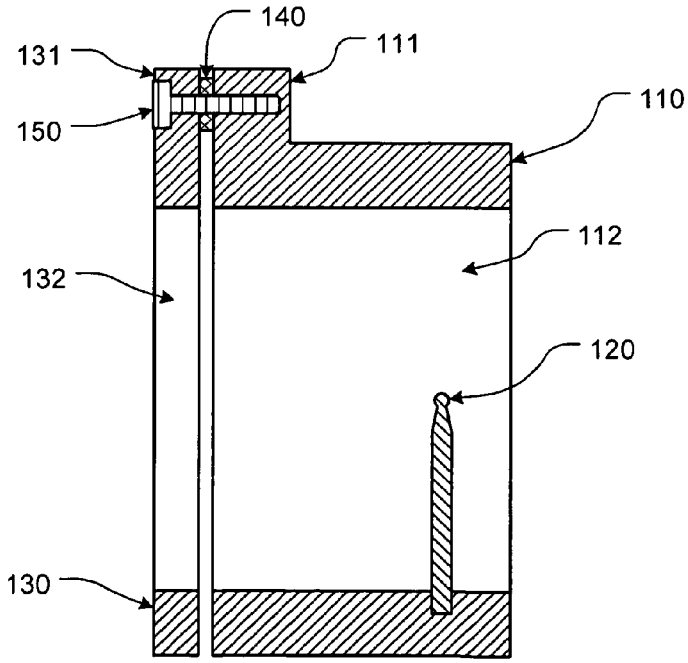
FIG. 12B shows a cross-sectional view taken along line C-C of the optical sight of FIG. 12A, illustrating the pivot housing.

As shown in FIG. 12B, it should be appreciated that a portion of the pivot pin 150 may be partially or completely recessed within the second side surface 136 of the eclipsed ring 130. While not shown, it should also be appreciated that a portion of the spacer 140 may be partially or completely recessed within the first side surface 134 of the eclipsed ring 130 and/or the second side surface 116 of the reference housing 110.

Figure 16:
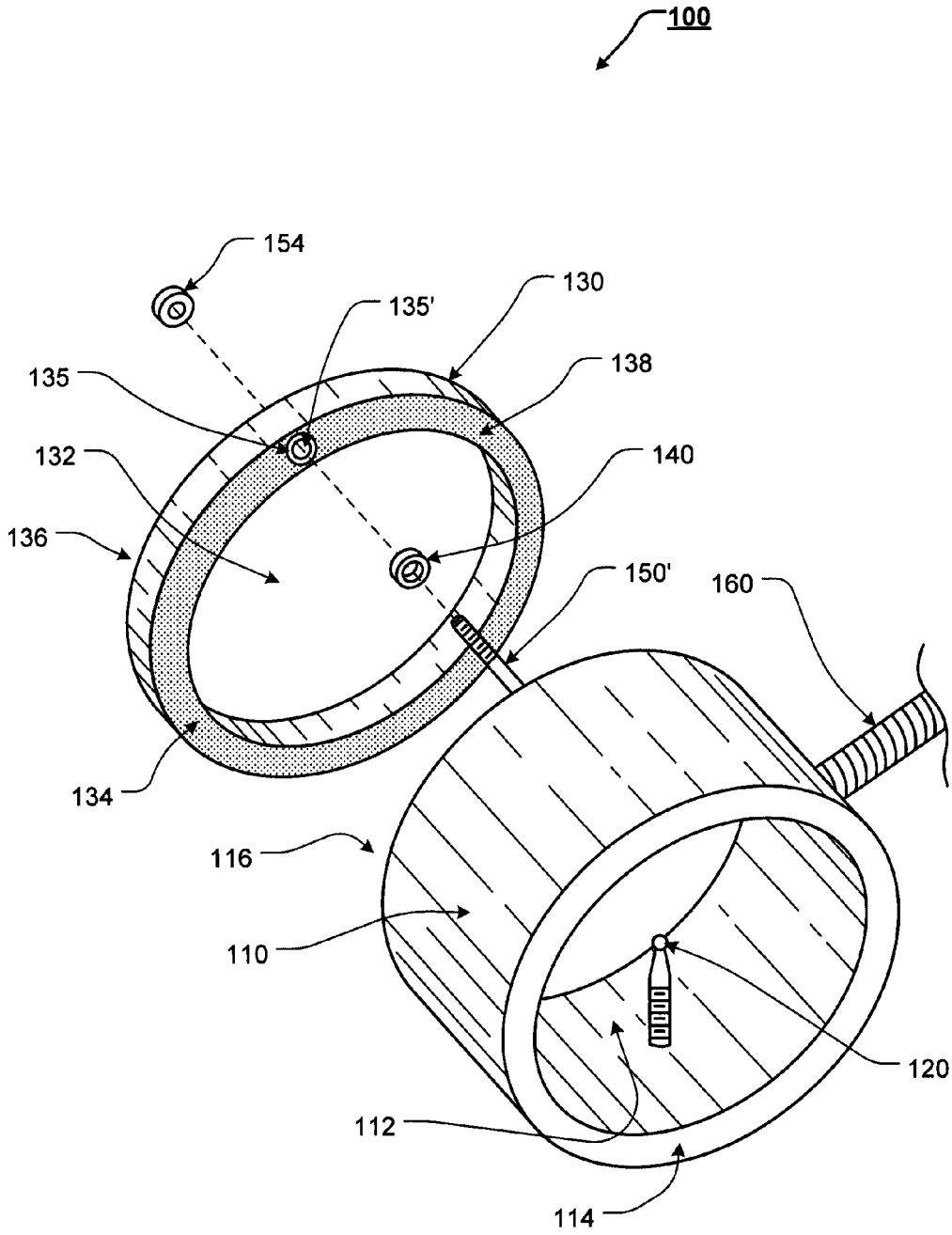
FIG. 16 shows an exploded perspective view of an additional exemplary embodiment of an optical sight according to this invention, wherein an alternate pivot pin configuration is displayed.

As illustrated in FIG. 16, in various exemplary embodiments, a pivot pin 150' may extend from the reference housing 110 in these exemplary embodiments, the eclipsed ring 130 is secured to the pivot pin 150' via a securing nut 154. It should also be appreciated that the pivot pin may extend from the eclipsed ring 130 to the secured to or within the reference housing 110.

The first side surface 134 of the eclipsed ring 130 is shaped such that when the eclipsed ring 130 is pivotably coupled, via the pivot pin 150, to the reference housing 110, one or more surface preparations 138 on the first side surface 134 of the eclipsed ring 130 is/are occluded by at least a portion of the second side surface 116 of the reference housing 110 when the reference housing 110 and the eclipsed ring 130 are aligned. When the reference housing 110 and the eclipsed ring 130 are not aligned, one or more of the surface preparations 138 of the eclipsed ring 130 are no longer occluded by the reference housing 110, but are visible to a user looking through the reference aperture 112.

Thus, when the surface preparations 138 of the eclipsed ring 130 are occluded by the reference housing 110, a user is assured that the reference point 120, and by extension, the device on which the optical sight is mounted, it is at a predetermined angle with respect to a plane.

In various exemplary embodiments, the one or more surface preparations 138 may include, for example, a color that contrasts a color present on at least a portion of the first side surface 114 of the reference housing 110 and/or within the reference aperture 112, a texture or other surface preparation or feature that contrasts the texture or surface preparation of at least a portion of the first side surface 114 of the reference housing 110 and/or the reference aperture 112, and/or a pattern that contrasts a pattern appearing on at least a portion of the first side surface 114 of the reference housing 110 and/or the reference aperture 112. In certain exemplary embodiments, the one or more surface preparations 138 may comprise various means for illuminating the first side surface 134 of the eclipsed ring 130 day, night, or low light situations, such as, for example, by the use of a fluorescent, phosphorescent, tritium, or other glow in the dark element, one or more light emitting diode (LED), and the like. It should be appreciated that the spectrum of light emitted by the illumination means can include visible or nonvisible wavelengths of light.

In various exemplary embodiments, the one or more of the surface preparations 138 may include a number of visible graduations that enable a user to determine degrees off level.

As illustrated in FIGS. 1-5A, the eclipsed ring 130 may comprise a ring of substantially the same inside and outside diameter as the reference housing 110. The eclipsed ring 130 may, for example, have a black exterior and interior, with a white (or other visually distinguished contrast color or texture) portion formed on the first side surface 134 of the eclipsed ring 130.

The housing attachment means 160 is used to attach or couple the reference housing 110 to a device, such as, for example, a bow. As illustrated, the attachment means 160 may comprise a threaded rod. Alternatively, the attachment means 160 may comprise a bracket, a quick disconnect, a magnetic attachment means, or other device, which provides means for attaching or coupling the reference housing 110 to a device such as a bow (not shown). In various exemplary embodiments, the attachment means 160 may comprise one or more screws, rivets, snap-together parts, eyelets, magnets, or any other known or later developed means for permanently or removably attaching or coupling the reference housing 110 to a host device. By utilizing any of the possible attachment means 160, the reference housing 110 may be retrofitted to an existing or future site or sighting device.

Alternatively, the reference housing 110 may be formed as an integral part or component of a device.

In various exemplary embodiments, at least certain components of the optical sight 100 are substantially rigid and are formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combination of the foregoing. Thus, it should be understood that the material or materials used to form the components of the optical sight 100 is a design choice based on the desired appearance and/or functionality of the optical sight, and are not limited to the aforementioned listing.

FIGS. 3A-5A illustrate a first exemplary embodiment of the optical sight 100, in use. In FIGS. 3A-5B, FIGS. 3A, 4A, and 5A show a front view of the optical sight 100 while FIGS. 3B, 4B, and 5B show a rear view of the optical sight 100. It should be appreciated that the front view illustrates the optical sight 100 as viewed by a user looking through the reference aperture 112, while the rearview illustrates the optical sight 100 as viewed from a target.

Figure 3A:
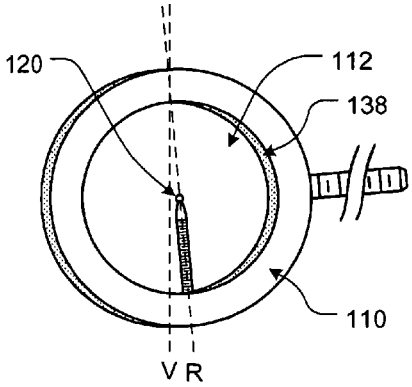
FIG. 3A shows a front view of the first exemplary embodiment of an optical sight according to this invention, wherein the eclipsed ring indicates that the reference housing is canted approximately 5 degrees from a vertical axis.
Figure 3B:
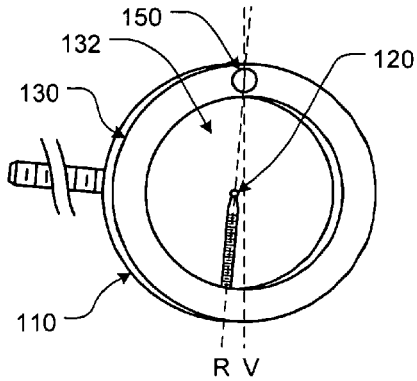
FIG. 3B shows a rear view of the first exemplary embodiment of an optical sight according to this invention; wherein the eclipsed ring indicates that the reference housing is canted approximately 5 degrees from a vertical axis.

When the optical sight 100 is assembled, as described above, the weight of the eclipsed ring 130 and the position of the pivot aperture 135' and pivot pin 150 gravity causes the eclipsed ring 130 to naturally rest at a vertical position, as indicated by the reference line "V". As illustrated in FIGS. 3A and 3B, when the reference housing 110 is canted approximately 5 degrees from a vertical axis "V", as indicated by the reference line "R", because an attached device is canted counterclockwise from a desired position, at least a portion of the one or more surface preparations 138 on the first side surface 134 of the eclipsed ring 130 is/are visible within the reference aperture 112, thereby indicating to a user that the attached device is not oriented at a desired, predetermined position that would result in the reference housing 110 being positioned at a vertical orientation.

Figure 4A:
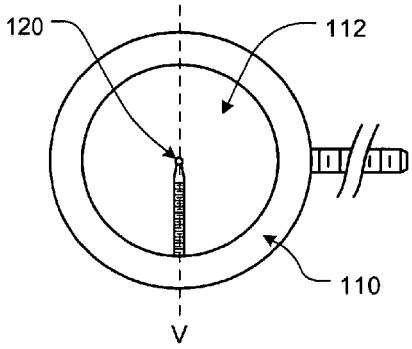
FIG. 4A shows a front view of the first exemplary embodiment of an optical sight according to this invention, wherein the eclipsed ring indicates that the reference housing is aligned with a vertical axis.
Figure 4B:
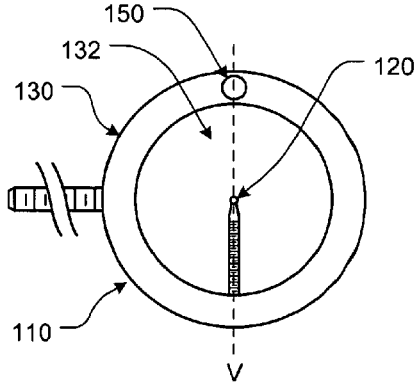
FIG. 4B shows a rear view of the first exemplary embodiment of an optical sight according to this invention, wherein the eclipsed ring indicates that the reference housing is aligned with a vertical axis.

As illustrated in FIGS. 4A and 4B, when the reference housing 110 is at the predetermined vertical position, because an attached device is oriented at a desired position, the one or more surface preparations 138 on the first side surface 134 of the eclipsed ring 130 is/are not visible within the reference aperture 112, thereby indicating to a user that the attached device is oriented at a desired, predetermined position that would result in the reference housing 110 being positioned at a vertical orientation.

Thus, when properly mounted and aimed, the reference point 120 can be placed on a target, and the user-facing surface preparations 138 of the eclipsed ring 130 will be completely eclipsed by at least a portion of the reference aperture 112 to form an accurate target picture.

Figure 5A:
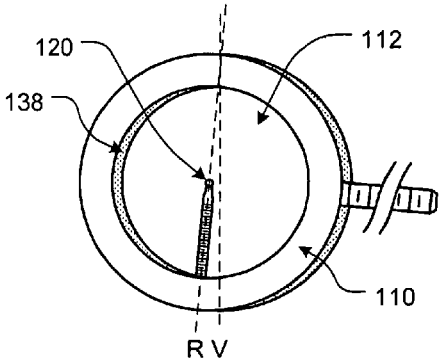
FIG. 5A shows a front view of the first exemplary embodiment of an optical sight according to this invention, wherein the eclipsed ring indicates that the reference housing is canted approximately −5 degrees from a vertical axis.
Figure 5B:
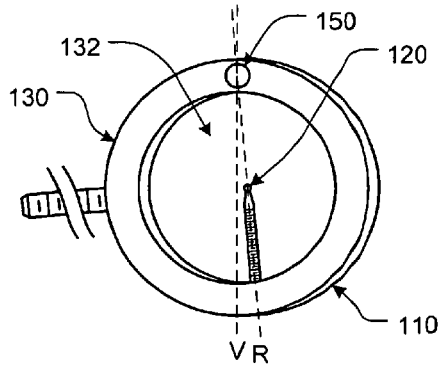
FIG. 5B shows a rear view of the first exemplary embodiment of an optical sight according to this invention, wherein the eclipsed ring indicates that the reference housing is canted approximately −5 degrees from a vertical axis.

As illustrated in FIGS. 5A and 5B, when the reference housing 110 is canted approximately −5 degrees from vertical axis "V", as indicated by the reference line "R", because an attached device is canted clockwise from a desired position, at least a portion of the one or more surface preparations 138 on the first side surface 134 of the eclipsed ring 130 is/are visible within the reference aperture 112, thereby indicating to a user that the attached device is not oriented at a desired, predetermined position that would result in the reference housing 110 being positioned at a vertical orientation.

Thus, during operation of the optical sight 100, when the surface preparations 138 on the first side surface 134 of the eclipsed ring 130 are occluded, either in whole or in part, as denoted by the surface preparations 138 on the first side surface 134 of the eclipsed ring 130, the user will, inherently, have a clear indication the bow or other targeted device is oriented at a predetermined angle or position, i.e., is level.

Figure 6:
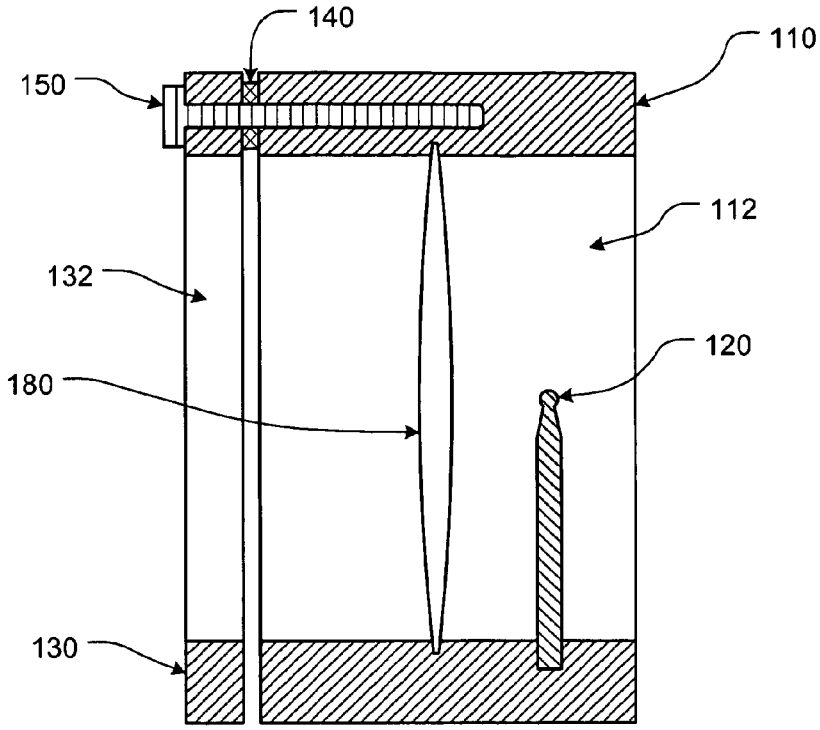
FIG. 6 shows a cross-sectional view taken along the vertical line V of the optical sight of FIGS. 4A and 4B, illustrating a first exemplary reference aperture according to this invention.

As illustrated in FIG. 6, one or more optical lenses 180 may be included within the reference aperture 112. If included, the lens(es) 180 can provide magnification to the optical sight 100. While not shown, it should be appreciated that one or more optical lenses may be included within the eclipsed ring aperture 132.

Figure 7:
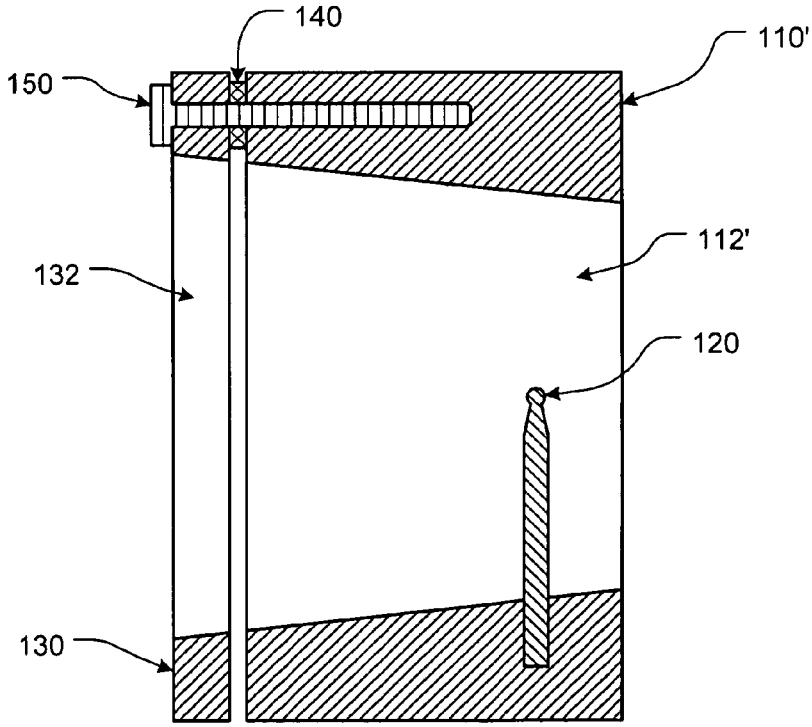
FIG. 7 shows a cross-sectional view taken along the vertical line V of the optical sight of FIGS. 4A and 4B, illustrating a second exemplary reference aperture according to this invention.

As illustrated in FIGS. 6 and 7, the reference housing 110 may be formed of substantially parallel interior walls that provide a substantially cylindrically shaped reference aperture 112, as illustrated in FIG. 6. Alternatively, as illustrated in FIG. 7, a reference housing 110' may include divergent walls that provide a substantially conically shaped reference aperture 112.

Figure 8A:
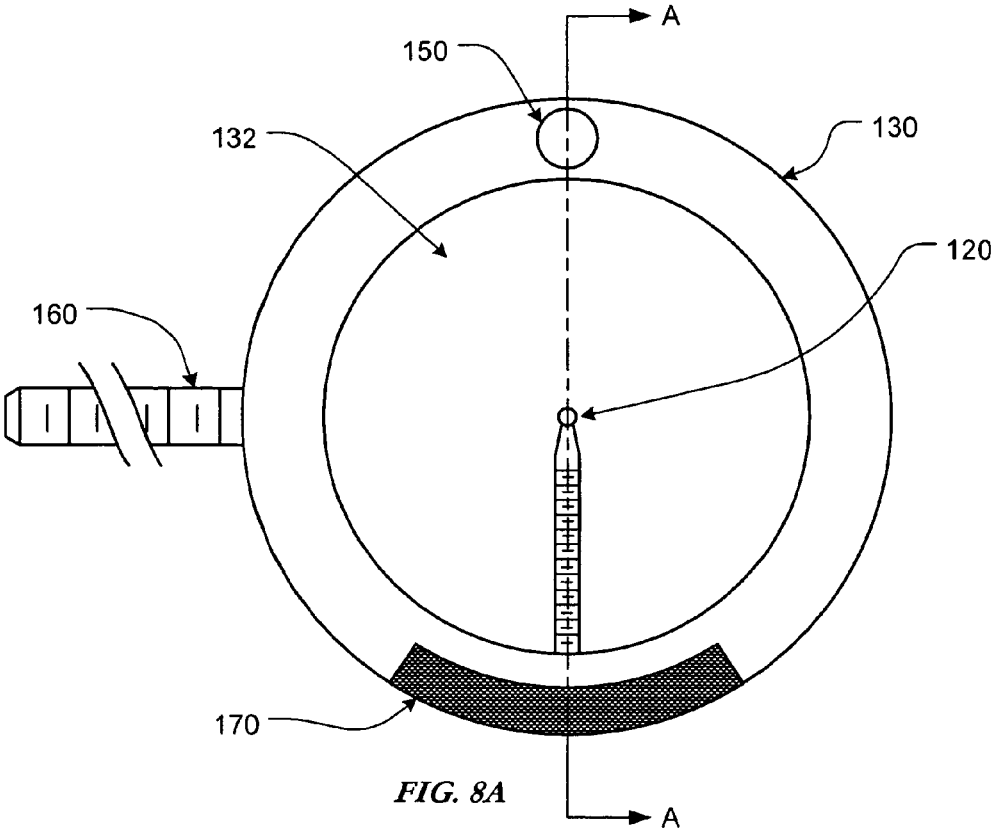
FIG. 8A shows a rear view of an exemplary embodiment of an optical sight according to this invention, wherein the eclipsed ring includes an embedded weight element.
Figure 8B:
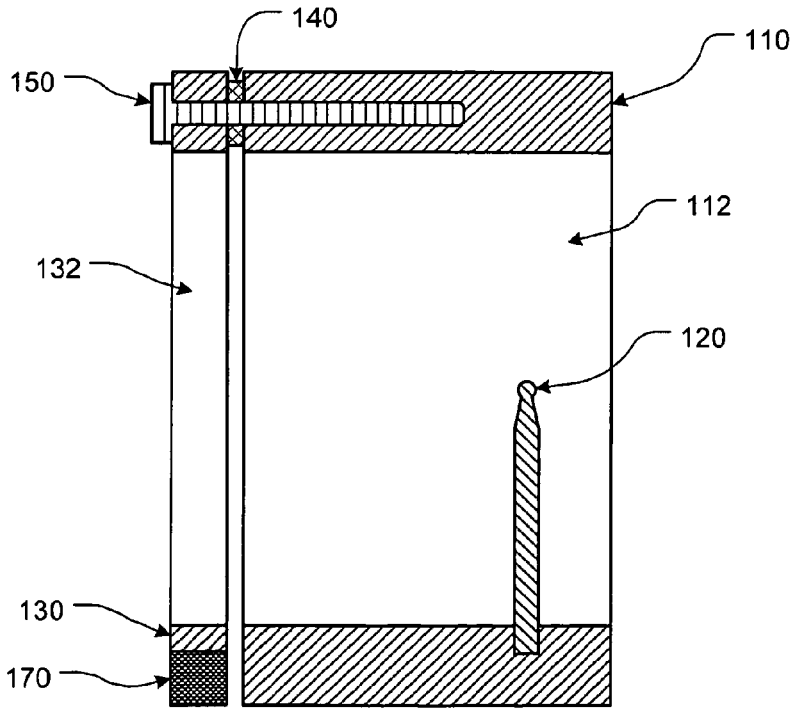
FIG. 8B shows a cross-sectional view taken along line A-A of the optical sight of FIG. 8A, illustrating the embedded weight element.

FIGS. 8A and 8B show a rear view and a cross-sectional view, respectively, of an exemplary embodiment of the optical sight 100, wherein the eclipsed ring 130 includes an embedded weight element 170. If included, the weight element 170 is embedded within the eclipsed ring 130 so as to add additional weight to further ensure that the eclipsed ring 130 naturally pivots to a desired position. It should be appreciated that the weight element 170, or the pivot pin 150, may be positioned such that the eclipsed ring 130 naturally pivots to a vertical position or to any other desired angular position.

Figure 9A:
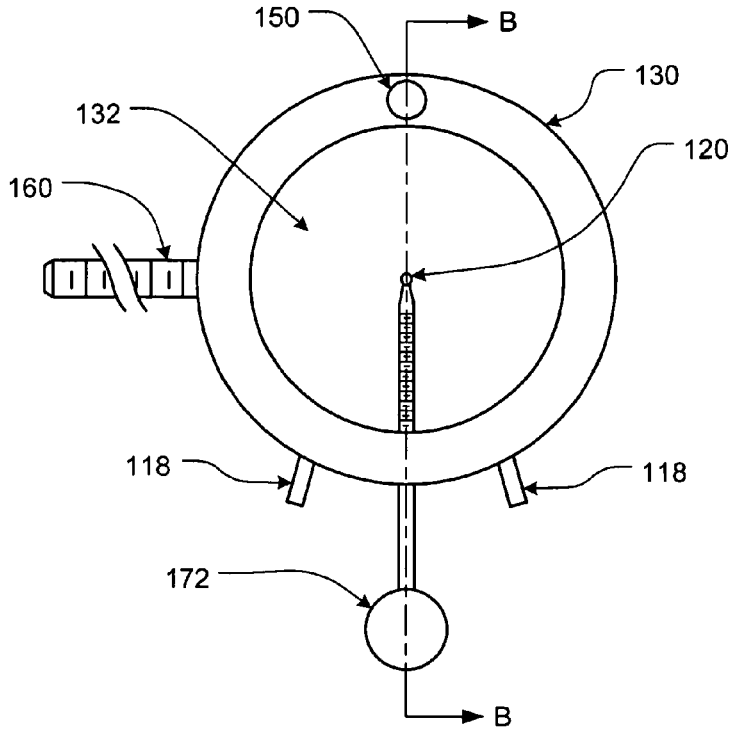
FIG. 9A shows a rear view of another exemplary embodiment of an optical sight according to this invention, wherein the eclipsed ring includes a pendulum weight element.
Figure 9B:
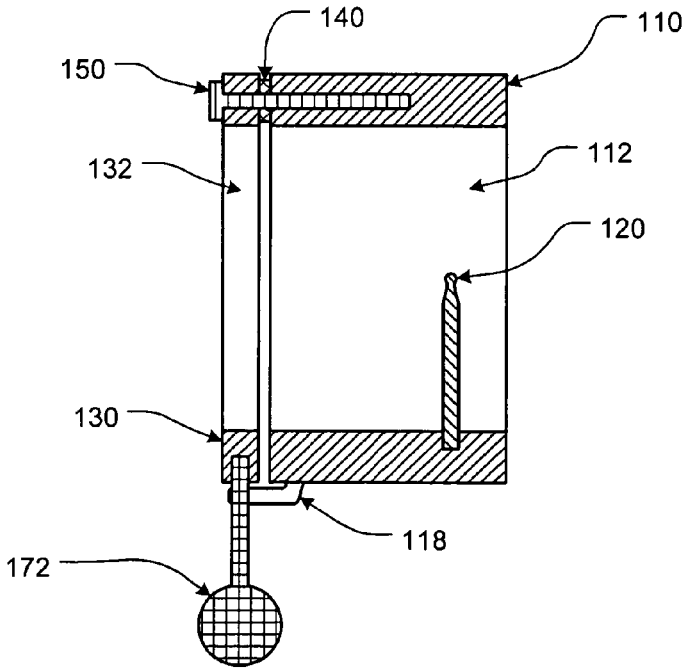
FIG. 9B shows a cross-sectional view taken along line B-B of the optical sight of FIG. 8A, illustrating the pendulum weight element.

FIGS. 9A and 9B show a rear view and a cross-sectional view, respectively, of an alternate embodiment of an optical sight 100 according to this invention. As illustrated in FIGS. 9A and 9B, a pendulum weight element 172 suspends from the eclipsed ring 130. If included, the pendulum weight element 172 extends from the eclipsed ring 130 so as to add additional weight to further ensure that the eclipsed ring 130 naturally pivots to a desired position. It should be appreciated that the pendulum weight element 172, or the pivot pin 150, may be positioned such that the eclipsed ring 130 naturally pivots to a vertical position or to any other desired angular position.

As also illustrated in FIGS. 9A and 9B, optional stops 118 may be included to keep the pendulum weight element 172, and the eclipsed ring 130, from rotating or pivoting beyond predetermined points, as defined the optional stops 118.

In various exemplary embodiments, a cover or shielding element may be included that shields at least a portion of the reference housing 110 or the eclipsed ring 130 from rain, wind, or other elements. If included, the cover or shielding element may also act as a stop for the eclipsed ring 130. The cover or shielding element may also be formed so as to reduce the visibility of the eclipsed ring 130, when the optical sight is viewed from the second side, or target side.

Figure 10:
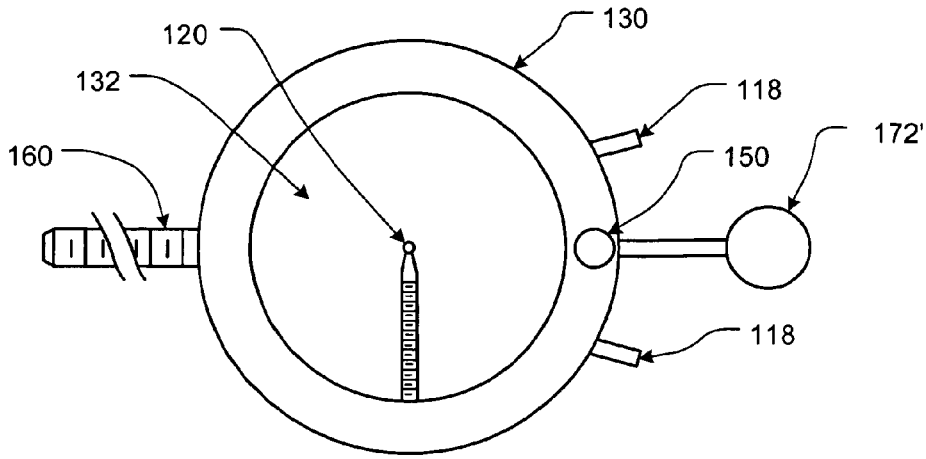
FIG. 10 shows a rear view of another exemplary embodiment of an optical sight according to this invention, wherein the pivot point is repositioned and the eclipsed ring includes a pendulum counterbalance.
Figure 11:
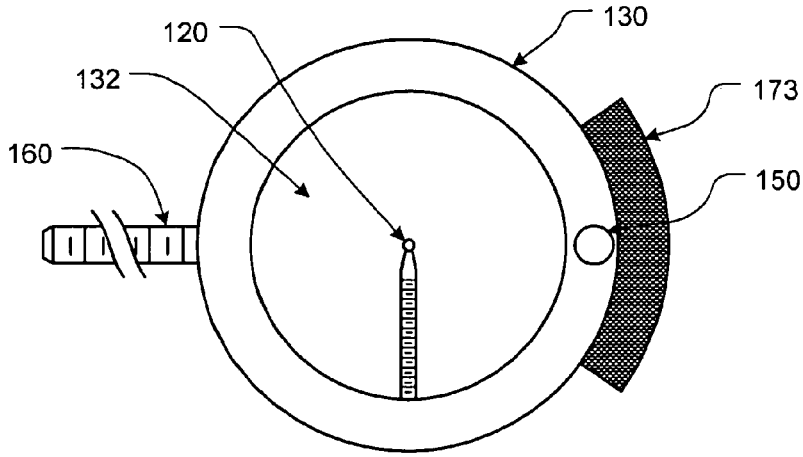
FIG. 11 shows a rear view of another exemplary embodiment of an optical sight according to this invention, wherein the pivot point is repositioned and the eclipsed ring includes an attached counterbalance.

As illustrated in FIGS. 10 and 11, the pivot pin 150, and thus the pivot point of the eclipsed ring 130 may be repositioned. As shown in FIG. 10, the pivot pin 150 is positioned at approximately a three o'clock position on the eclipsed ring 130, as opposed to being positioned at approximately a twelve o'clock position on the eclipsed ring 130. In order to maintain a desired, natural rotational position of the eclipsed ring 130, a pendulum counterbalanced 172' extends from the eclipsed ring 130. It should be appreciated that the weight of the counterbalance 172' and the distance of the counterbalance 172' from the pivot point of the eclipsed ring 130 is a design choice based upon the weight of the eclipsed ring 130 and the relative position of the pivot pin 150.

As shown in FIG. 11, the pivot pin 150 is again positioned at approximately a three o'clock position on the eclipsed ring 130, as in FIG. 10. However, as shown in FIG. 11, in order to maintain a desired, natural rotational position of the eclipsed ring 130, a weighted counterbalanced 173 is attached or coupled to the eclipsed ring 130. It should be appreciated that the weight of the counterbalance 173 and the position of the counterbalance 173 relative to the pivot point of the eclipsed ring 130 is a design choice based upon the weight of the eclipsed ring 130 and the relative position of the pivot pin 150.

FIGS. 12A and 12B show a rear view and a cross-sectional view, respectively, of an optical sight according to this invention, wherein the pivot point and the pivot pin 150 are positioned within a pivot housing. In the illustrated exemplary embodiments, the eclipsed ring 130 includes an extended portion 131 and the reference housing 110 includes extended portion 111, which provide for receipt of the pivot pin 150. In certain exemplary embodiments, the extended portions 131 and 111 are formed integral to the eclipsed ring 130 and the reference housing 110, respectively. Alternatively, the pivot housing may be formed of separate components that are attached or coupled to the eclipsed ring 130 and the reference housing 110.

Figure 13:
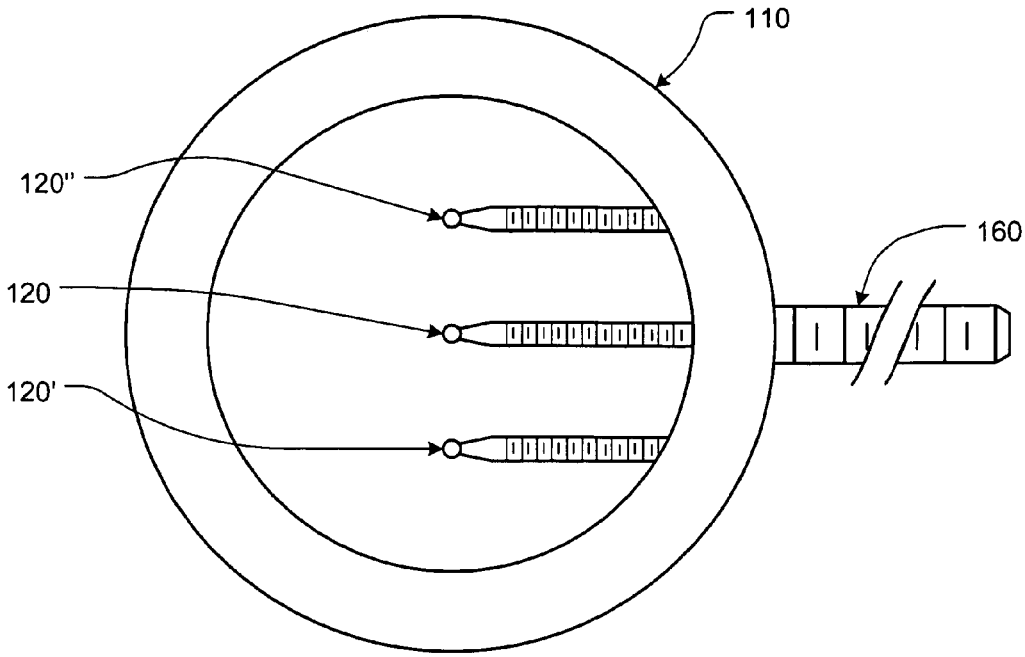
FIG. 13 shows a front view of an exemplary embodiment of an optical sight according to this invention, wherein the optical sight includes a plurality of reference points.

It should be appreciated that while the optical sight 100 has been described as having a single reference point 120 positioned within the reference aperture 112, multiple reference points may be positioned within the reference aperture 112. Therefore, as illustrated in FIG. 13, a plurality of reference points, such as, for example, 120, 120', and 120" may be included within the reference aperture 112. Additionally, it should be appreciated that the reference point(s) may be attached or suspended to a post or other element having a substantially horizontal, vertical, or other angular orientation.

Figure 14:
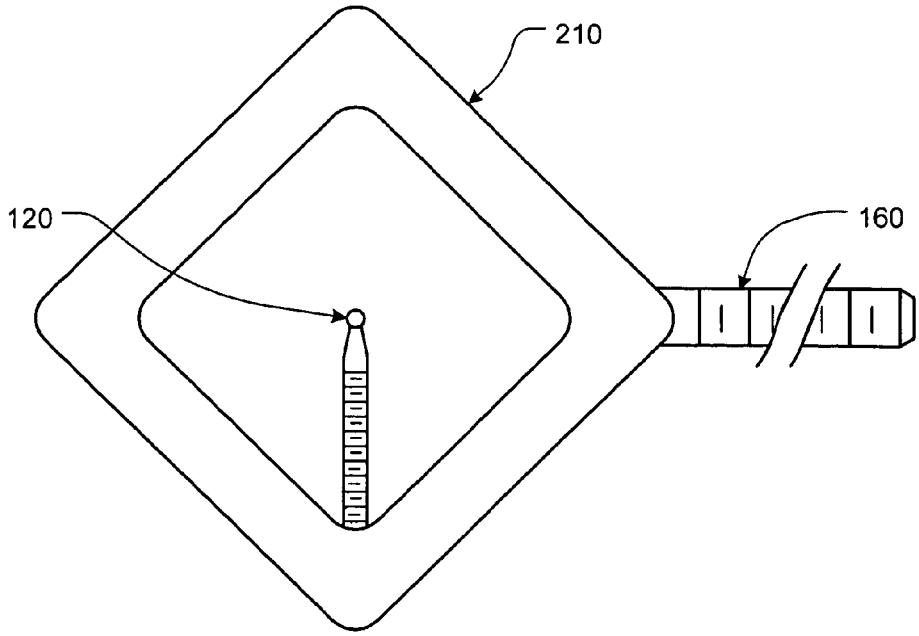
FIG. 14 shows a front view of an exemplary embodiment of an optical sight according to this invention, wherein an alternate geometry is displayed.

Additionally, it should be appreciated that the overall size and shape of the reference housing 110 and/or the eclipsed ring 130 is a design choice based upon the desired functionality and/or appearance of the optical sight 100. Thus, while the optical sight 100 has been shown and described essentially as having a circular reference housing 110 and eclipsed ring 130, the overall size and shape of the reference housing 110 and/or the eclipsed ring 130 may vary. As illustrated in FIG. 14, the optical sight 100 may have, for example, a substantially diamond-shaped reference housing 210 and eclipsed ring. However, it should be appreciated that the overall size and shape of the elements of the optical sight 100 are not to be limited to the relative sizes and shapes illustrated and any size, shape, or orientation may be used to produce the elements of the optical sight of this invention.

Figure 15:
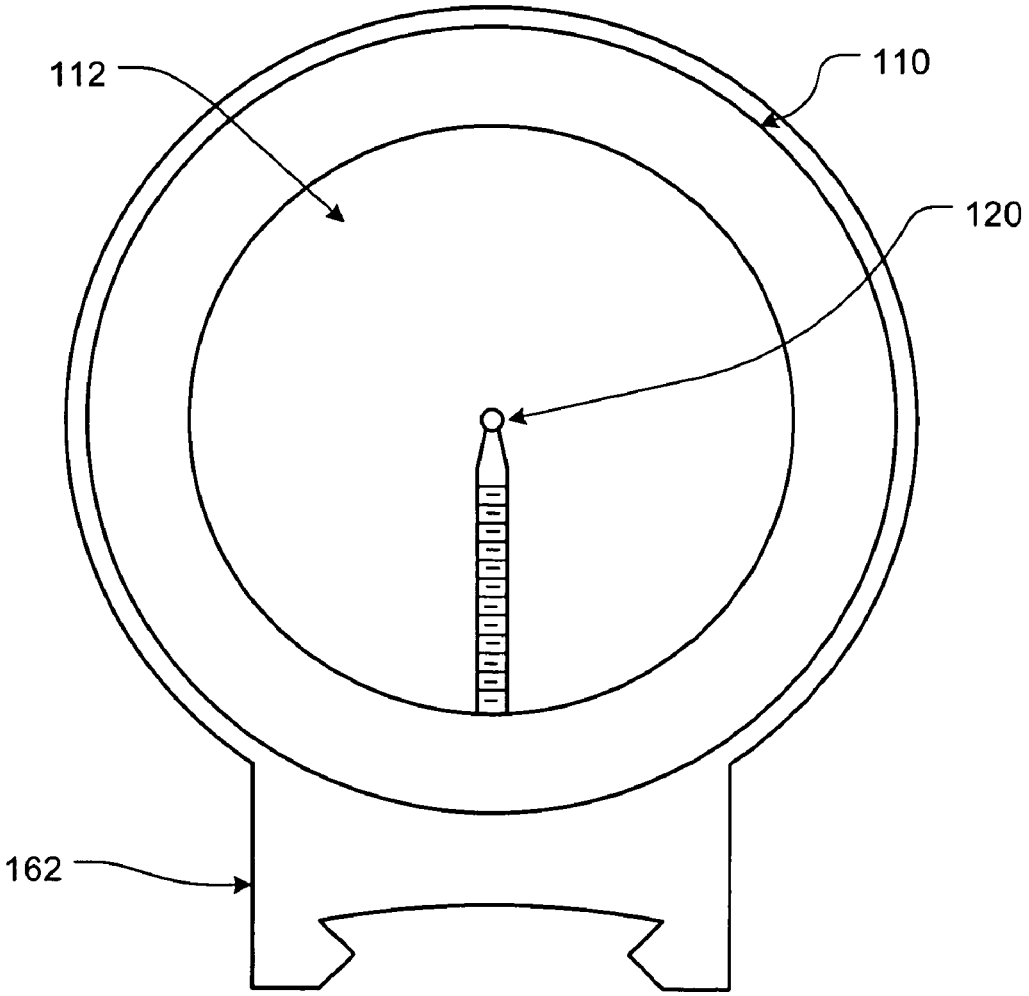
FIG. 15 shows a front view of an exemplary embodiment of an optical sight according to this invention, wherein an alternate housing attachment means is displayed.

In certain exemplary embodiments, the housing attachment means 160 is not included and, instead, an alternate means for attaching or coupling the reference housing 110 to a device is used. For example, as illustrated in FIG. 15, an alternate housing attachment means 162 is displayed. As shown, the housing attachment means 162 is similar to a traditional scope ring adapted to be fitted to a groove or rail mounting system, such as, for example, a Picatinny rail. In this manner, the reference housing 110 can be mounted on any number of devices.

Figure 17A:
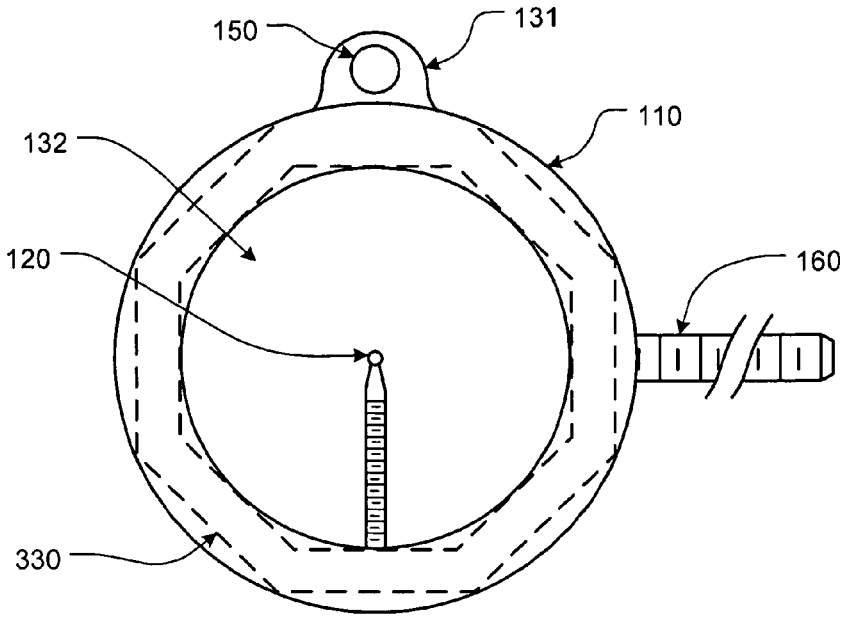
FIG. 17A shows a front view of an exemplary embodiment of an optical sight according to this invention, wherein the eclipsed ring comprises a substantially different geometry to the geometry of the reference housing and wherein the eclipsed ring indicates that the reference houing is aligned with a vertical axis.
Figure 17B:
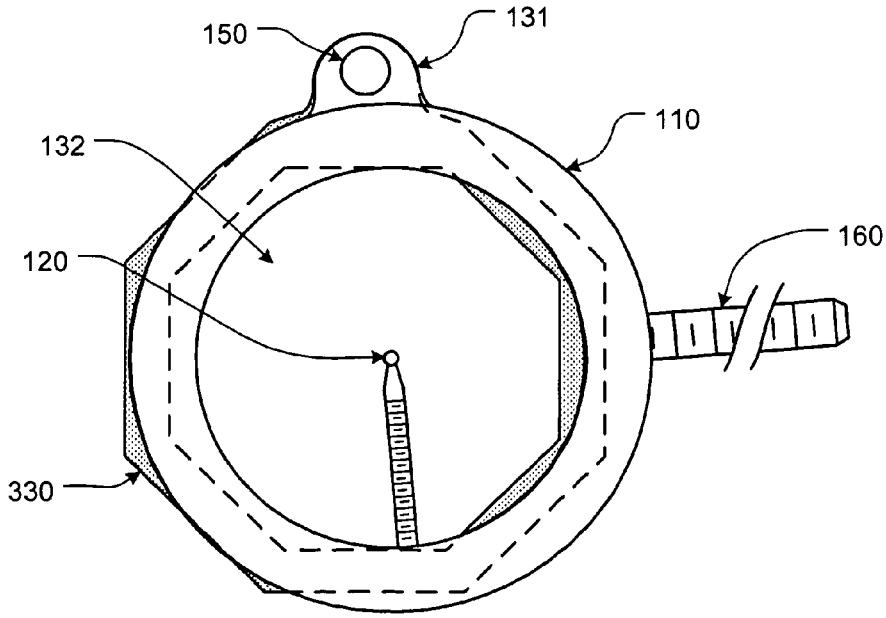
FIG. 17B shows a front view of an exemplary embodiment of the optical sight of FIG. 17A, wherein the eclipsed ring indicates that the reference housing is canted approximately 5 degrees from a vertical axis.
Figure 18A:
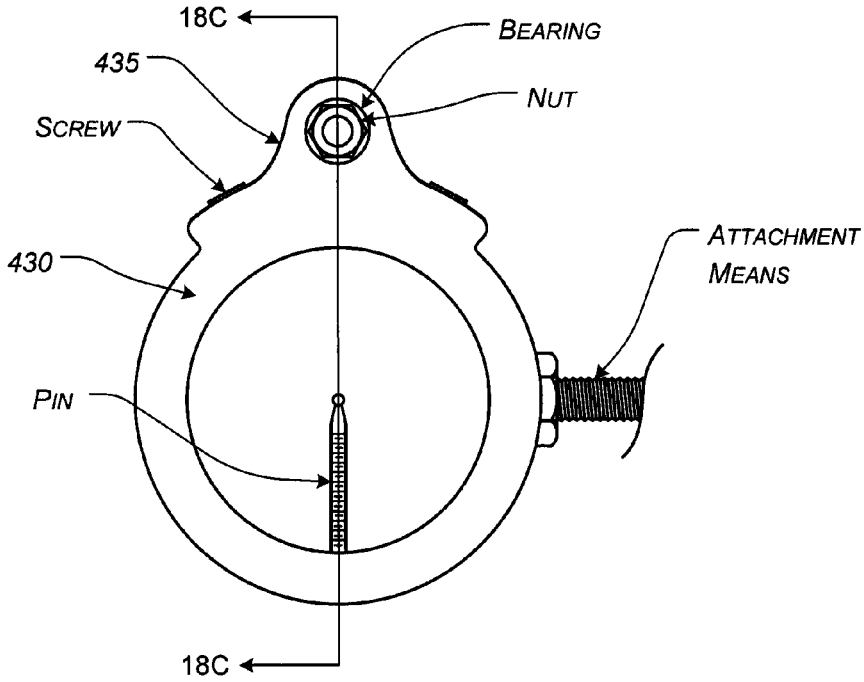
FIG. 18A shows a front view of an exemplary embodiment of an optical sight according to this invention.
Figure 18B:
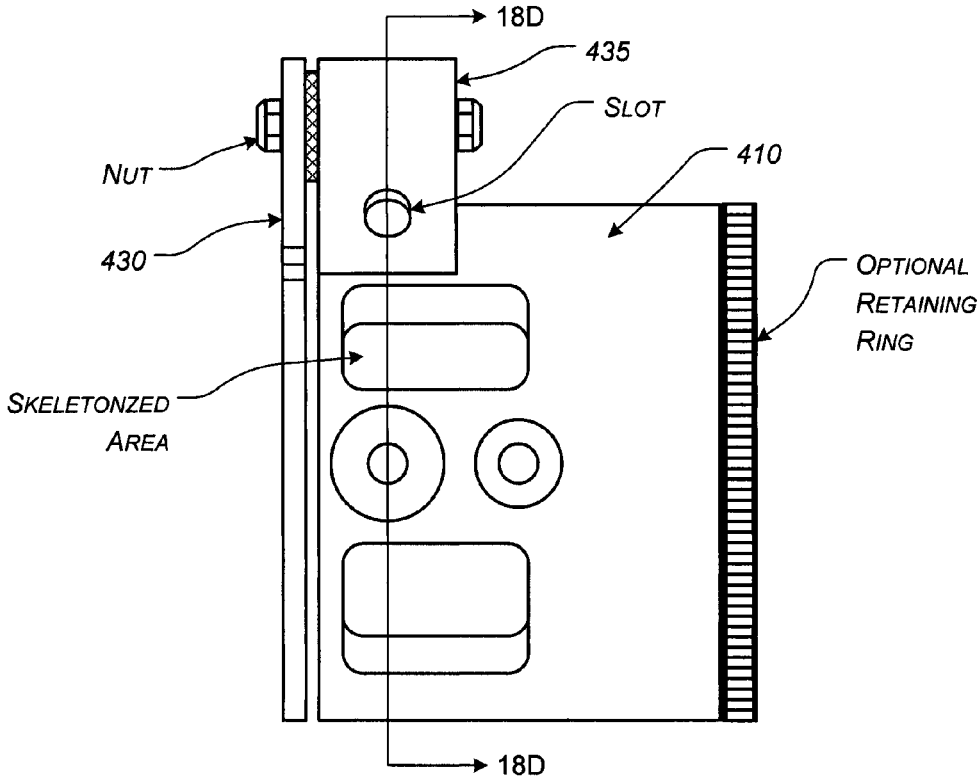
FIG. 18B shows a side view of an exemplary embodiment of an optical sight according to this invention.
Figure 18C:
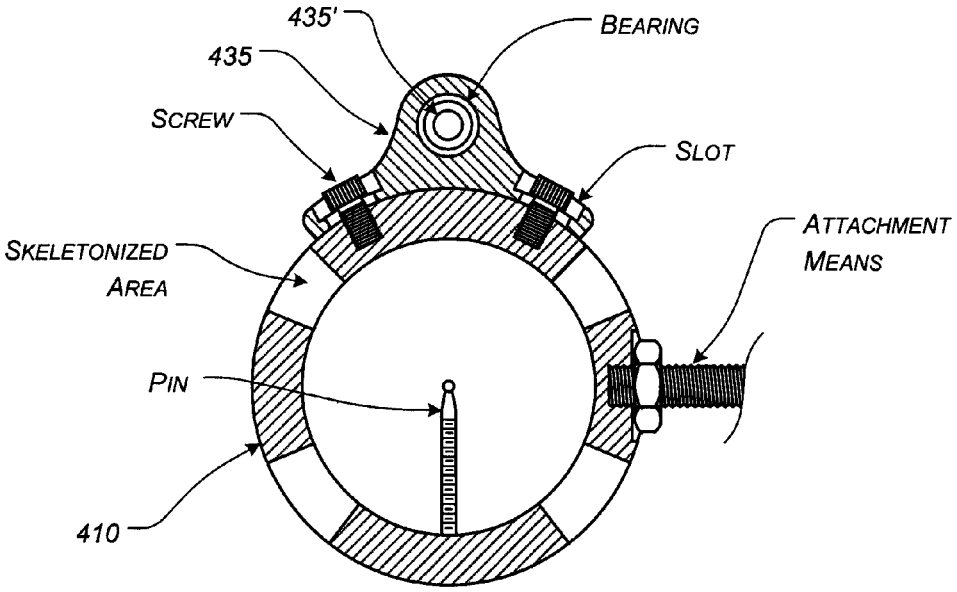
FIG. 18C shows a cross-sectional view taken along line C-C of the optical sight of FIG. 18A.
Figure 18D:
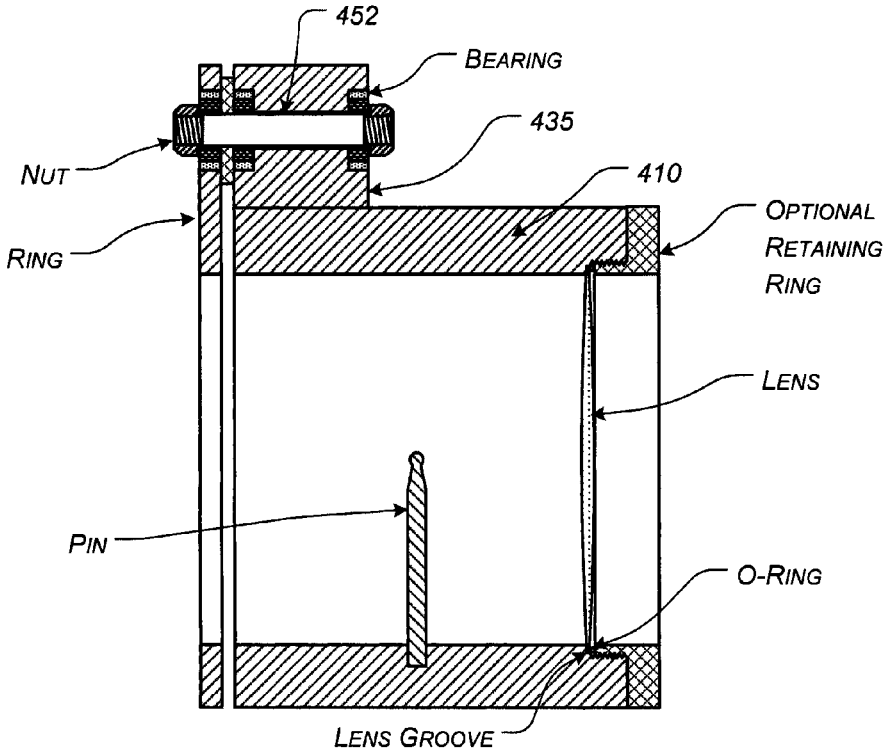
FIG. 18D shows a cross-sectional view taken along line D-D of the optical sight of FIG. 18B.

FIGS. 17A and 17B show front views of an exemplary embodiment of an optical sight according to this invention, wherein the eclipsed ring 330 comprises a substantially different geometry to the geometry of the reference housing 110. As illustrated in FIG. 17A, the eclipsed ring 330 is aligned with the reference housing 110 indicating that optical sight is properly aligned along a vertical axis.

In FIG. 17B, the optical sight is canted approximately 5 degrees from a vertical axis. Thus, as illustrated, certain portions of the eclipsed ring 330 are visible outside of the reference housing 110.

FIGS. 18A-18D show an exemplary embodiment of an optical sight according to this invention, wherein the eclipsed ring 430 a pillow, or bearing block 435 is coupled to the reference housing 410.

As illustrated in FIGS. 18A-D, the pillow block includes a pivot aperture 435' formed therein such that the eclipsed ring 430 can be coupled, via a pivot pin 452 extending into or through the pivot aperture 435'. In this manner, the eclipsed ring 430 may pivot relative to the reference housing 410 and the pillow block 435.

In various exemplary embodiments, the pillow block may be attached to an existing scope or other housing, such that the eclipsed ring can be retrofitted to an existing scope housing.

Figure 19:
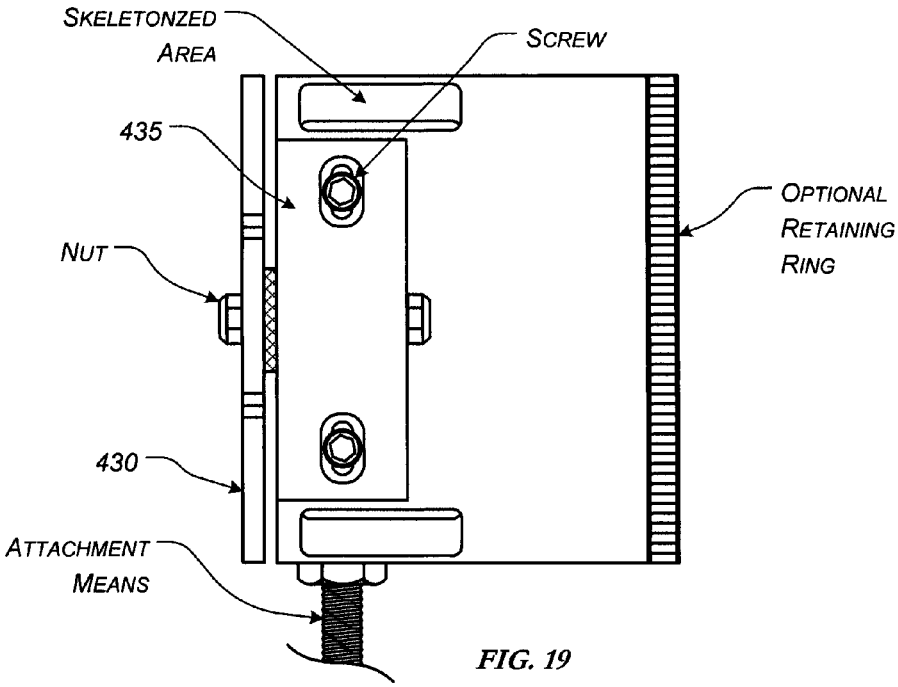
FIG. 19 shows a top view of an exemplary embodiment of an optical sight according to this invention.

FIG. 19 shows a top view of an exemplary embodiment of an optical sight according to this invention.

Figure 20A:
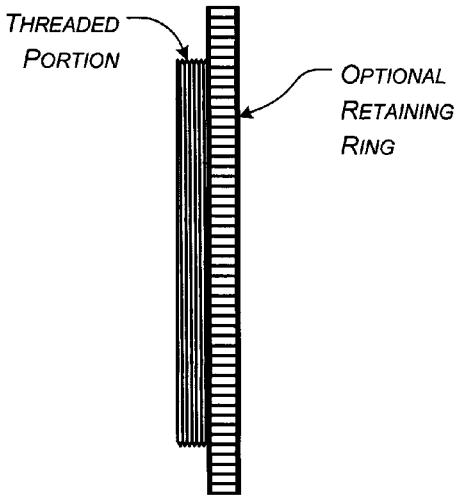
FIG. 20A shows a side view of an exemplary embodiment of an optional retaining ring according to this invention.
Figure 20B:
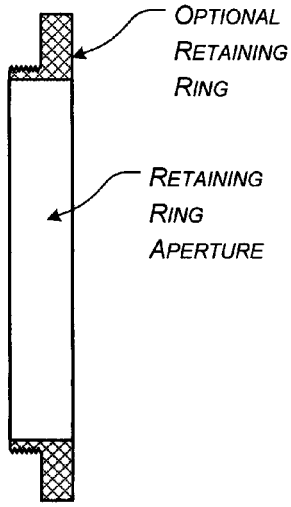
FIG. 20B shows a cross-sectional view of the exemplary embodiment of the optional retaining ring of FIG. 20A.

FIG. 20A shows a side view of an exemplary embodiment of an optional retaining ring according to this invention, while FIG. 20B shows a cross-sectional view of the optional retaining ring of FIG. 20A.

Figure 21:
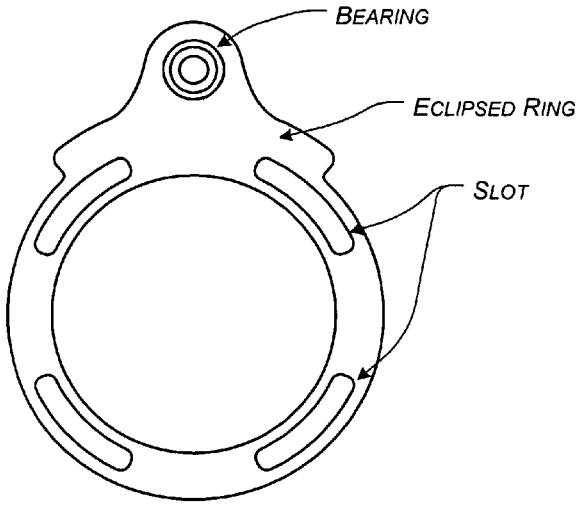
FIG. 21 shows a front view of an exemplary embodiment of an optional eclipsed ring according to this invention.

FIG. 21 shows a front view of an exemplary embodiment of an optional eclipsed ring according to this invention.

Figure 22:
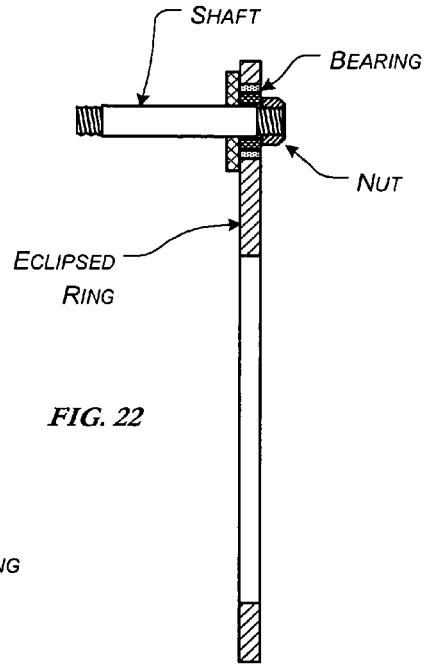
FIG. 22 shows a cross-sectional view of the exemplary embodiment of the eclipsed ring and pivot pin according to this invention.

FIG. 22 shows a cross-sectional view of the exemplary embodiment of the eclipsed ring and pivot pin according to this invention.

Figure 23:
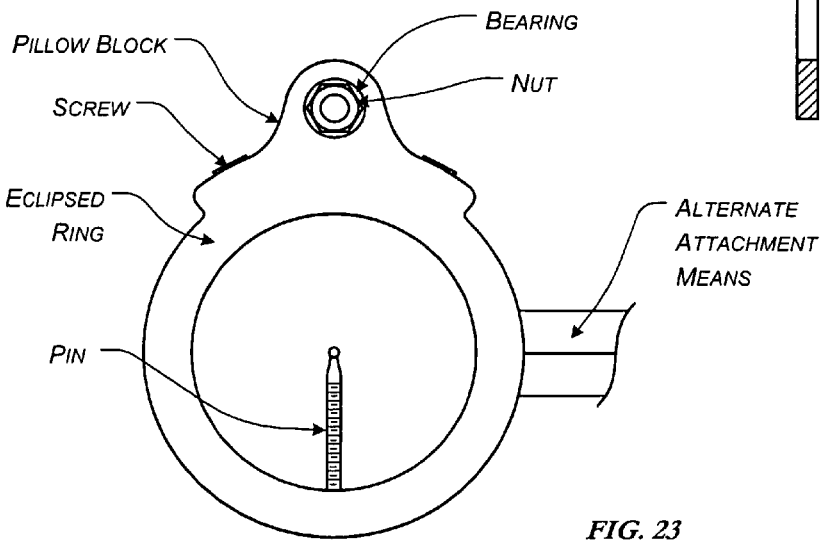
FIG. 23 shows a front view of an exemplary embodiment of an optical sight according to this invention, wherein the optical sight includes an alternate attachment means according to this invention.

FIG. 23 shows a front view of an exemplary embodiment of an optical sight according to this invention, wherein the optical sight includes an alternate attachment means according to this invention.

Figure 24A:
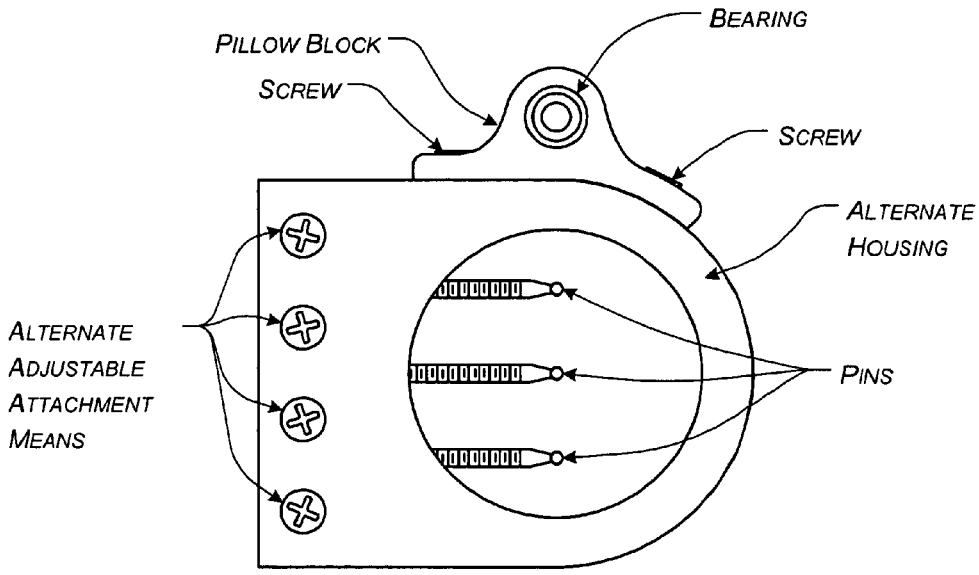
FIG. 24A shows a rear view of an exemplary embodiment of an optical sight according to this invention, wherein the optical sight includes an alternate attachment housing according to this invention.

FIG. 24A shows a rear view of an exemplary embodiment of an optical sight according to this invention, wherein the optical sight includes an alternate attachment housing according to this invention.

Figure 24B:
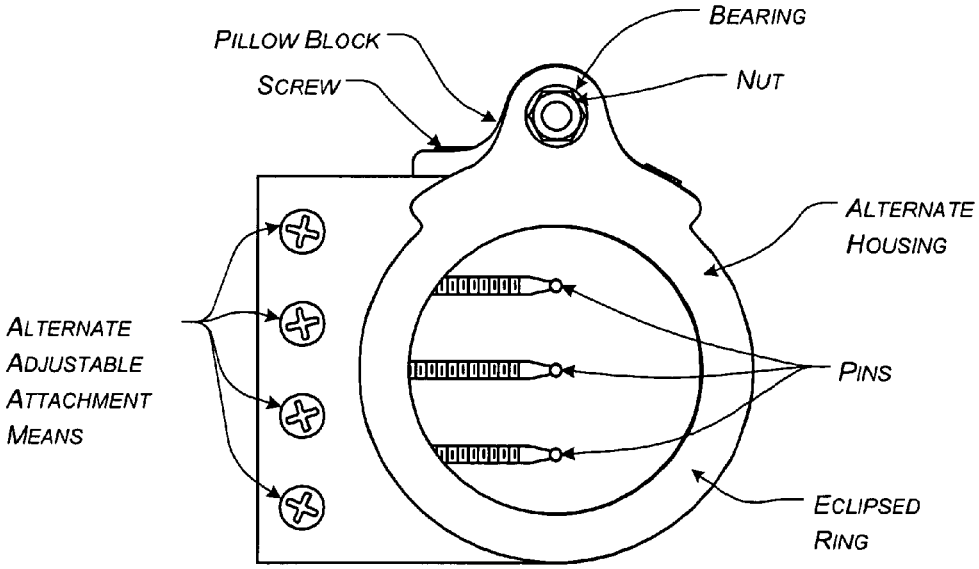
FIG. 24B shows a front view of an exemplary embodiment of an optical sight according to this invention, wherein the optical sight includes an alternate attachment housing according to this invention.

FIG. 24B shows a front view of an exemplary embodiment of an optical sight according to this invention, wherein the optical sight includes an alternate attachment housing according to this invention.

Figure 25A:
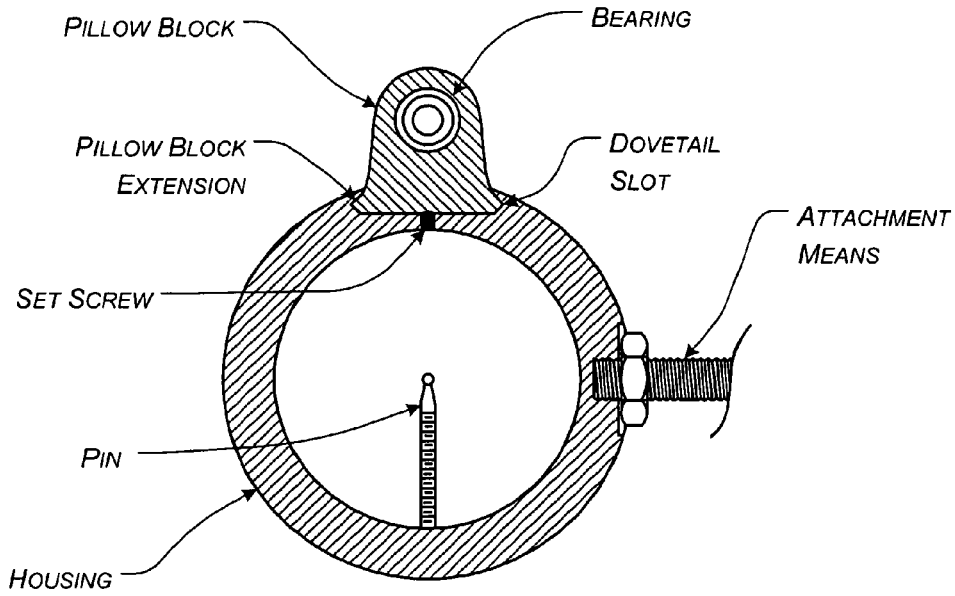
FIG. 25A shows a cross-sectional view of an exemplary embodiment of an optical sight according to this invention.

FIG. 25A shows a cross-sectional view of an exemplary embodiment of an optical sight according to this invention.

Figure 25B:
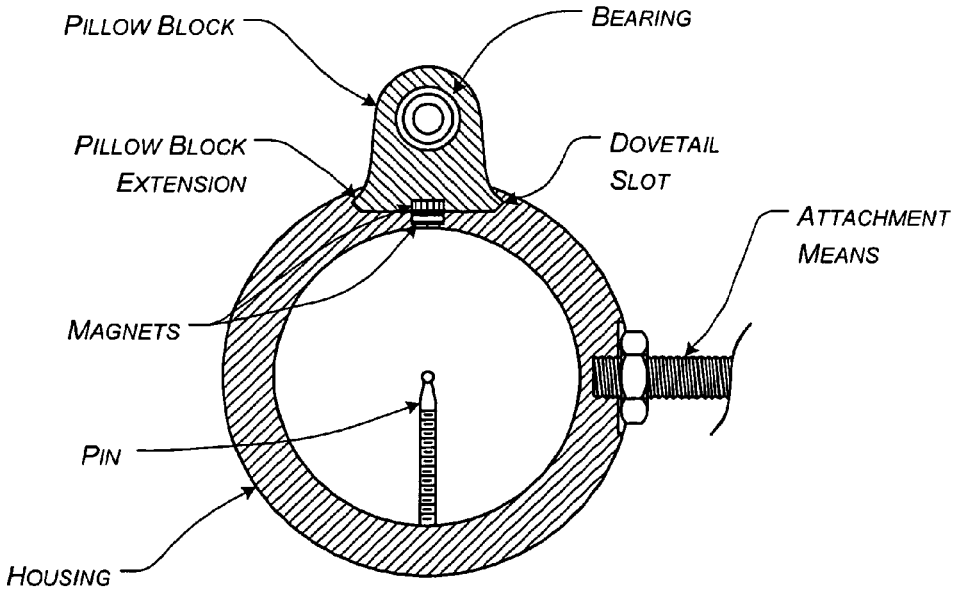
FIG. 25B shows a cross-sectional view of an exemplary embodiment of an optical sight according to this invention.

FIG. 25B shows a cross-sectional view of an exemplary embodiment of an optical sight according to this invention.

In various exemplary embodiments, the pivot point does not have to attach directly to the reference housing, the pivot pin can be attached or coupled to a bracket that is not attached to the reference housing. In these embodiments, the reference housing, pillow, or bearing block, and eclipsed ring can be independent.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. For example, the optical sight of this invention can be formed as a single, enclosed unit that can be attached, coupled, or formed as an integral part of a device.

Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. An optical sight, comprising:

a reference housing extending from a first side surface to a second side surface and having a reference housing aperture formed within the reference housing;

a pillow block extending from a first side surface to a second side surface, wherein the pillow block is coupled to the reference housing;

at least one reference point positioned within the reference housing aperture;

an eclipsed ring extending from a first side surface to a second side surface and having an eclipsed ring aperture formed within the eclipsed ring;

wherein the eclipsed ring includes a pivot aperture formed therein, wherein the eclipsed ring is pivotably coupled, via a pivot pin extending through the pivot aperture, to the pillow block such that the eclipsed ring may pivot relative to the reference housing and such that the eclipsed ring naturally pivots to a predetermined position, and wherein the eclipsed ring is pivotably coupled such that the first side surface of the eclipsed ring faces generally towards the second side surface of the reference housing; and at least one surface preparation on the first side surface of the eclipsed ring, wherein the surface preparation is visually distinguishable from a surface of the reference housing aperture formed within the reference housing;

wherein the first side surface of the eclipsed ring is shaped such that when the reference housing and the eclipsed ring are aligned, the at least one surface preparation on the first side surface of the eclipsed ring is not visible through the reference housing aperture.

2. The optical sight of claim 1, wherein an arbitrary spacer or space is positioned between the pillow block and the eclipsed ring to separate the second side surface of the pillow block from the first side surface of the eclipsed ring.

3. The optical sight of claim 1, wherein the reference housing comprises an elongate cylinder.

4. The optical sight of claim 1, wherein the reference housing comprises an arbitrary geometry.

5. The optical sight of claim 1, wherein the reference point is mounted at a center of the reference housing aperture.

6. The optical sight of claim 1, wherein a plurality of reference points are positioned within the reference housing aperture.

7. The optical sight of claim 1, wherein the eclipsed ring comprises a substantially similar geometry to a geometry of the reference housing.

8. The optical sight of claim 1, wherein the eclipsed ring comprises a substantially different geometry to a geometry of the reference housing.

9. The optical sight of claim 1, wherein the first side surface of the eclipsed ring is shaped such that when the reference housing and the eclipsed ring are not aligned, at least a portion of the at least one surface preparation on the first side surface of the eclipsed ring is visible through the reference housing aperture.

10. The optical sight of claim 1, wherein the one or more surface preparations comprise a color or a texture.

11. The optical sight of claim 1, further including a housing attachment means for attaching the reference housing to a device.

12. The optical sight of claim 11, wherein the housing attachment means comprises a threaded rod, a scope ring mount, a mount point, a bracket, a quick disconnect, a magnetic attachment means, one or more screws, one or more bolts, one or more rivets, one or more snap-together parts, one or more eyelets, adhesives, tapes, magnets or any other means of attachment or one or more magnets.

13. The optical sight of claim 1, wherein one or more optical lenses are included within the reference housing aperture.

14. The optical sight of claim 1, wherein the eclipsed ring includes an embedded weight element.

15. The optical sight of claim 1, wherein the eclipsed ring includes a pendulum weight element.

16. The optical sight of claim 1, wherein the pivot aperture is formed at approximately a twelve o'clock position on the eclipsed ring.

17. The optical sight of claim 1, wherein the pivot aperture is formed at approximately a three o'clock position on the eclipsed ring.

18. The optical sight of claim 1, wherein the pivot aperture is positioned within an extended portion of the eclipsed ring and the pivot pin is positioned within an extended portion of the reference housing.

19. An optical sight, comprising:

a pillow block extending from a first side surface to a second side surface, wherein the pillow block is capable of being attached or coupled to a scope housing;

an eclipsed ring extending from a first side surface to a second side surface and having an eclipsed ring aperture formed within the eclipsed ring;

wherein the eclipsed ring includes a pivot aperture formed therein, wherein the eclipsed ring is pivotably coupled, via a pivot pin extending through the pivot aperture, to the pillow block such that the eclipsed ring may pivot relative to the scope housing and such that the eclipsed ring naturally pivots to a predetermined position, and wherein the eclipsed ring is pivotably coupled such that the first side surface of the eclipsed ring faces generally towards the second side surface of a reference housing; and at least one surface preparation on the first side surface of the eclipsed ring, wherein the surface preparation is visually distinguishable from a surface of a scope housing aperture formed within the scope housing;

wherein the first side surface of the eclipsed ring is shaped such that when the scope housing and the eclipsed ring are aligned, the at least one surface preparation on the first side surface of the eclipsed ring is not visible through the scope housing aperture.

* * * * *